US006281766B1

(12) United States Patent
Malone et al.

(10) Patent No.: US 6,281,766 B1
(45) **Date of Patent: *Aug. 28, 2001**

(54) STACKED PIEZOELECTRIC ACTUATORS TO CONTROL WAVEGUIDE PHASE SHIFTERS AND METHOD OF MANUFACTURE THEREOF

(75) Inventors: Hugh Robert Malone, Phoenix; Deborah Sue Dendy, Tempe; Dean Lawrence Cook, Mesa, all of AZ (US); James R. Phillips; Richard S. Kommrusch, both of Albuquerque, NM (US)

(73) Assignee: Motorola, Inc., Schaumburg, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/088,255

(22) Filed: Jun. 1, 1998

(51) Int. Cl.[7] ..... H01P 1/18
(52) U.S. Cl. ..... 333/159; 343/778
(58) Field of Search ..... 333/157, 159; 343/778, 702

(56) References Cited

U.S. PATENT DOCUMENTS

| | | | | |
|---|---|---|---|---|
| 3,166,723 | | 1/1965 | Bock et al. | 333/111 |
| 3,218,580 | * | 11/1965 | Kowsky | 343/778 X |
| 3,277,489 | * | 10/1966 | Blaisdell | 343/778 X |
| 4,127,834 | | 11/1978 | Stringfellow et al. | 333/229 |
| 4,238,662 | | 12/1980 | Lao | 29/25.41 X |
| 4,292,659 | | 9/1981 | Lao | 361/283 |
| 4,380,747 | | 4/1983 | Curtinot et al. | 333/202 |
| 4,575,697 | * | 3/1986 | Rao et al. | 333/157 |
| 4,768,001 | * | 8/1988 | Chan-Son-Lint et al. | 343/771 X |
| 5,504,466 | * | 4/1996 | Chan-Son-Lint et al. | 333/159 |
| 5,543,765 | | 8/1996 | Cachier | 333/246 |

* cited by examiner

*Primary Examiner*—Benny Lee
(74) *Attorney, Agent, or Firm*—James E. Klekotka; Frank J. Bogacz

(57) ABSTRACT

Waveguide phase shifter (200, FIG. 2 and 300, FIG. 3) uses piezoelectric ceramics to implement a voltage variable actuator (270, 370) for moving at least one dielectric vane (255, 355) relative to a reference surface (206, 306) in a waveguide cavity (285, 385). In this manner, the phase shift in waveguide phase shifters (200, 300) is controlled. In one embodiment, actuator (270) comprises first piezoelectric wafer (210), second piezoelectric wafer (220), first metallic layer (230), second metallic layer (240), third metallic layer (250), mating surface (272) and spacer (265). Actuator (270) uses a stack of piezoelectric materials to establish a lever arm mechanism to establish vertical movement (294) and move dielectric vane (255). Actuator (370) uses a stack of piezoelectric materials to establish vertical movement (394) and move dielectric vane (355). Waveguide phase shifters (200, 300) are used in phased array antenna (400) operating at microwave frequencies.

18 Claims, 4 Drawing Sheets

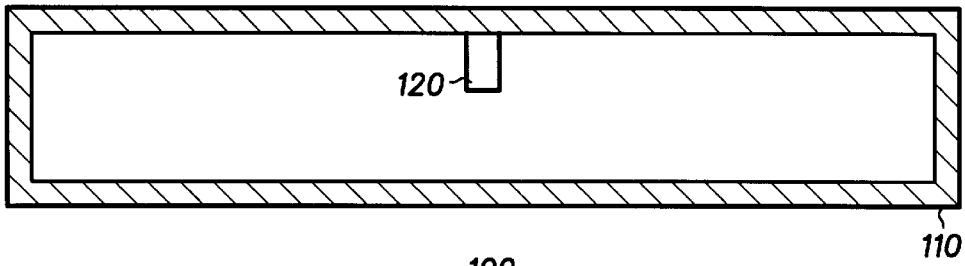
FIG. 1
- PRIOR ART -
FIG. 2
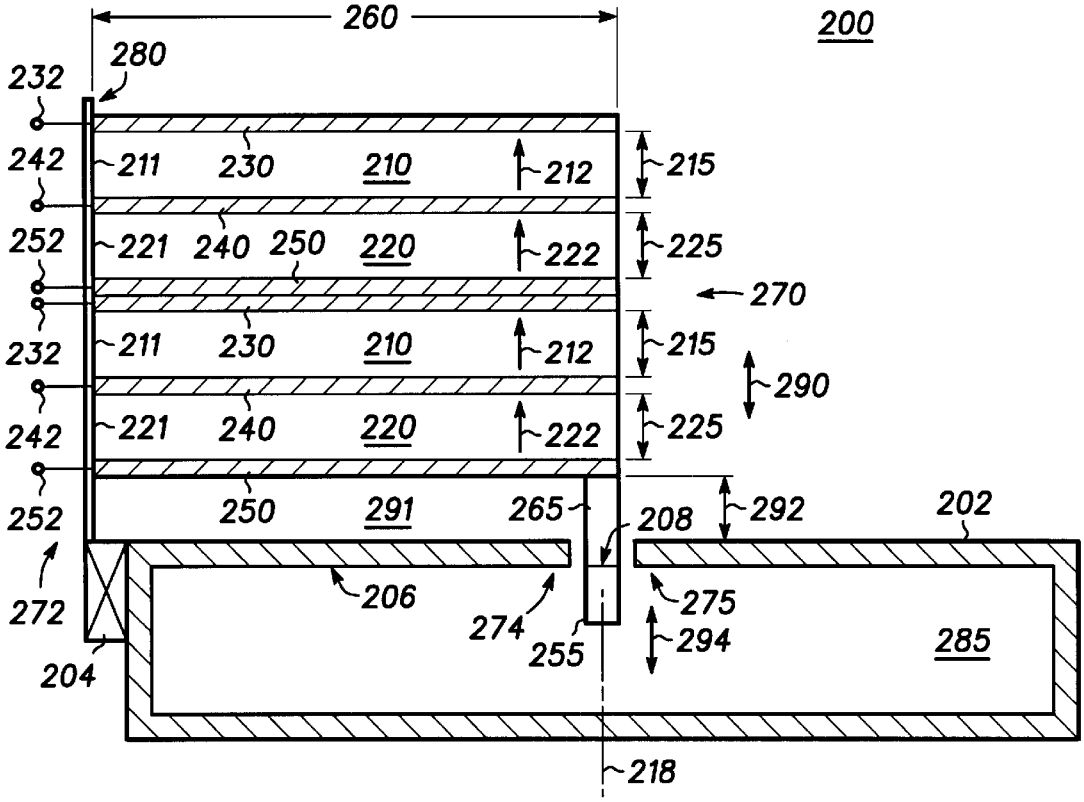

600

STACKED PIEZOELECTRIC ACTUATORS TO CONTROL WAVEGUIDE PHASE SHIFTERS AND METHOD OF MANUFACTURE THEREOF

CROSS-REFERENCE TO RELATED INVENTIONS

The present invention is related to the following inventions filed concurrently herewith and assigned to the same assignee as the present invention:

(1) U.S. patent Ser. No. 09/088,256, entitled "Voltage Variable Capacitor Array And Method Of Manufacture Thereof"; now U.S. Pat. No. 6,088,214 and (2) U.S. Pat. No. 6,016,122, issued Jan. 18, 2000, entitled "Phased Array Antenna Using Piezoelectric Actuators In Variable Capacitors To Control Phase Shifters And Method Of Manufacture Thereof".

FIELD OF THE INVENTION

The present invention relates generally to a phased array antenna and, more particularly, to a phased array antenna that uses piezoelectric actuators to control waveguide phase shifters and a method of manufacture thereof.

BACKGROUND OF THE INVENTION

The piezoelectric effect is a property that exists in many materials. In a piezoelectric material, the application of a force or stress results in the development of an electric charge in the material. This is known as the direct piezoelectric effect. Conversely, the application of an electric field to the same material will result in a change in mechanical dimensions or strain. This is known as the indirect piezoelectric effect.

Traditionally, phased array antennas were not fabricated using the indirect piezoelectric effect because this effect results in a limited range of movement. Phased array antennas have been designed with controllable phase shifters, but the limited range of movement provided by the indirect piezoelectric effect caused phased array designers to use other techniques to implement controllable phase shifters.

Thus, what is needed is an apparatus that uses the indirect piezoelectric effect in a controllable waveguide phase shifter in a phased array antenna operating at microwave frequencies as well as a method of manufacture thereof.

BRIEF DESCRIPTION OF THE DRAWINGS

A more complete understanding of the invention can be derived by referring to the detailed description and claims when considered in connection with the figures, wherein like reference numbers refer to similar items throughout the figures, and:

FIG. 1 shows a simplified view of a waveguide phase shifter as practiced in the prior art;

FIG. 2 illustrates a simplified view of a waveguide phase shifter in accordance with a preferred embodiment of the invention;

DETAILED DESCRIPTION OF A PREFERRED EMBODIMENT

Figure 3:
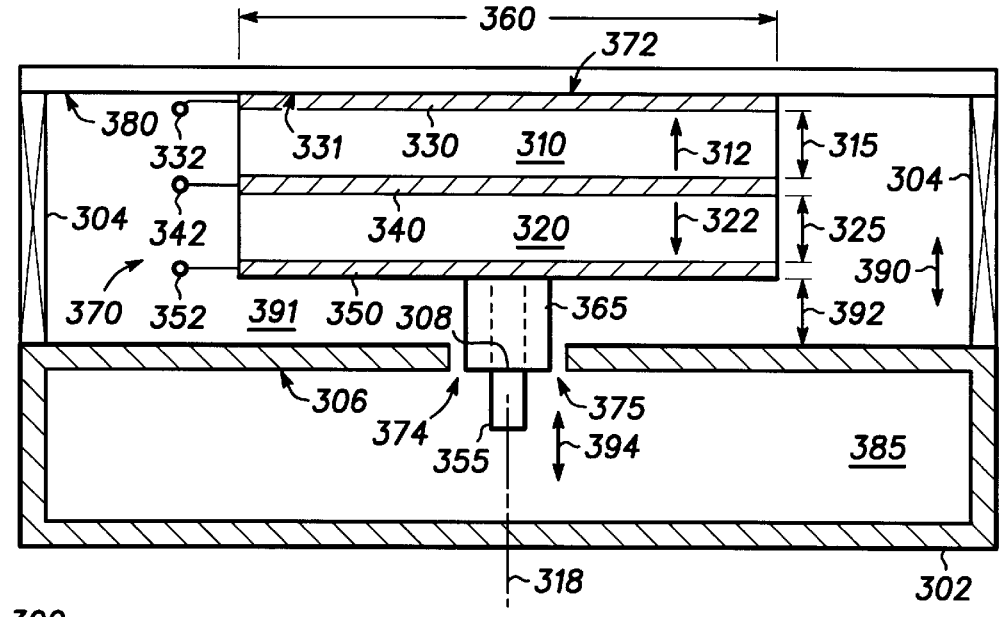
FIG. 3 illustrates a simplified view of a waveguide phase shifter in accordance with an alternate embodiment of the invention.

The invention provides an apparatus that uses the indirect piezoelectric effect in a controllable waveguide phase shifter in a phased array antenna operating at microwave frequencies. In particular, the invention uses piezoelectric ceramics to implement a voltage variable actuator for moving at least one dielectric vane relative to a waveguide wall. The present invention also provides a method of manufacturing such a waveguide phase shifter.

FIG. 1 shows a simplified view of a waveguide phase shifter as practiced in the prior art. Waveguide phase shifter 100 comprises waveguide 110 and dielectric vane 120.

FIG. 2 illustrates a simplified view of a waveguide phase shifter in accordance with a preferred embodiment of the invention. In a preferred embodiment, waveguide phase shifter 200 comprises waveguide 202, dielectric vane 255, attachment device 204, control port 275, piezoelectric actuator 270, and attachment plane 280. In addition, FIG. 2 illustrates first reference surface 206, second reference surface 208, gap 274, centerline 218, and waveguide cavity 285. Those skilled in the art will recognize that reference surfaces 206, 208 could be illustrated differently, and those embodiments would remain within the scope of this invention.

In a preferred embodiment, actuator 270 is coupled to waveguide 202 using at least one attachment device 204. Those skilled in the art will recognize that alternate embodiments can be envisioned in which attachment device 204 is not required. Those skilled in the art will also recognize that alternate embodiments can be envisioned in which attachment device 204 is used to couple actuator 270 to a different point on waveguide 202.

In a preferred embodiment, dielectric vane 255 is coupled to actuator 270 using spacer 265, although this is not required for the invention. In alternate embodiments, dielectric vane can be coupled to actuator 270 using different methods.

In a preferred embodiment, the amount of phase shift provided by waveguide phase shifter 200 is controlled by, among other things, the position of dielectric vane 255 in waveguide cavity 285. Those skilled in the art will recognize that alternate embodiments can be envisioned in which dielectric vane 255 is located in a different position relative to centerline 218. For example, dielectric vane 255 could be located in an offset position relative to centerline 218.

In a preferred embodiment, dielectric vane 255 is a rectangular piece of dielectric material having stable dielectric properties at the operating frequency for waveguide phase shifter 200, although this is not required for the invention. In alternate embodiments, different shapes can be used.

In a preferred embodiment, dielectric vane 255 is inserted into waveguide cavity 285 through control port 275. Control port 275 comprises a rectangular opening, which is machined into one of the walls of waveguide 202, although this is not required for the invention. In alternate embodiments, different shapes can be used for the opening, and different fabrication methods can be used.

In this embodiment, gap 274 is minimized, although this is not required for the invention. Gap 274 allows dielectric vane 255 to move freely within waveguide cavity 285.

In a preferred embodiment, second reference surface 208 is located relative to first reference surface 206. In this embodiment, second reference surface 208 is located within the same plane as first reference surface 206 during at least one step in a fabrication process.

In FIG. 2, actuator 270 is illustrated as comprising two stacks. This is done to simplify the explanation and understanding of the invention, and it is not intended to be limiting.

In a preferred embodiment, actuator 270 comprises a plurality of stacks coupled to each other. Desirably, a stacked configuration is used for actuator 270 to allow lower voltages to be used to achieve the same overall total displacement.

In a preferred embodiment, a stack comprises first piezoelectric wafer 210, second piezoelectric wafer 220, first metallic layer 230, second metallic layer 240 third metallic layer 250, and mating surface 272. Those skilled in the art will recognize that alternate embodiments can be envisioned which do not use a lever arm mechanism as illustrated in FIG. 2. For example, "oil-canning" mechanisms could be used in which more than one attachment point is used, and the actuator is positioned differently than that illustrated in FIG. 2.

In FIG. 2, first metallic layer 230 is coupled to a first surface of first piezoelectric wafer 210. In this embodiment, the first surface of first piezoelectric wafer 210 has been metalized using a well-known metalization technique.

In FIG. 2, third metallic layer 250 is coupled to a second surface of second piezoelectric wafer 220. In this embodiment, the second surface of second piezoelectric wafer 220 has been metalized using a well-known metalization technique.

In FIG. 2, second metallic layer 240 is coupled to a second surface of first piezoelectric wafer 210 and is coupled to a first surface of second piezoelectric wafer 220. In this embodiment, the second surface of first piezoelectric wafer 210 and the first surface of second piezoelectric wafer 220 have been metalized using a well-known metalization technique. The two metalized surfaces have been mated together to form second metallic layer 240.

In FIG. 2, terminal 232 is coupled to first metallic layer 230; terminal 252 is coupled to third metallic layer 250; terminal 242 is coupled to second metallic layer 240. In various embodiments, terminals 232, 242, and 252 can be configured in a number of different ways.

In a preferred embodiment, one end of spacer 265 is coupled to a second end of piezoelectric actuator 270, which is opposite from mating surface 272. In this embodiment, coupling is both mechanical and electrical. The other end of spacer 265 is coupled to dielectric vane 255 at second reference surface 208. The coupling between dielectric vane 255 and spacer 265 is both mechanical and electrical.

In a preferred embodiment, mating surface 272 of actuator 270 is coupled to attachment plane 280. In this embodiment, end 211 of first piezoelectric wafer 210 is coupled to attachment plane 280. In addition, end 221 of second piezoelectric wafer 220 is coupled to attachment plane 280. In this embodiment, attachment plane 280 is coupled to waveguide 202 using at least one attachment device 204.

This means one end (at mating surface 272) of actuator 270 is fixed. In this way, ends 211, and 221 of piezoelectric wafers 210, and 220, respectively, are fixed, and these ends 211, and 221 are not allowed to move relative to first reference surface 206. Those skilled in the art will recognize that alternate embodiments can be envisioned in which a different attachment plane can be used, and these embodiments are within the scope of the invention.

In a preferred embodiment, spacing 291 is provided to allow movement as illustrated by double-headed arrow 292 to occur between a surface of actuator 270 and a surface of waveguide 202.

In a preferred embodiment, first piezoelectric wafer 210 has length 260, thickness 215, and polarity 212. In this embodiment, second piezoelectric wafer 220 has length 260, thickness 225, and polarity 222. In a preferred embodiment, length 260, thickness 215 and thickness 225 are determined using known displacement equations to provide the required amount of movement as illustrated by double-headed arrow 290 and related movement as illustrated by double-headed arrow 294. In this embodiment, movement as illustrated by double-headed arrow 290 occurs at one end of a lever arm having length 260, and movement as illustrated by double-headed arrow 294 occurs due to a slightly shorter lever arm. in some embodiments, movement as illustrated by double-headed arrow 290 and movement as illustrated by double-headed arrow 294 could be equal.

In a preferred embodiment, polarity 212 is established using a first poling voltage, and polarity 222 is established using a second poling voltage. In this embodiment, two separate piezoelectric wafers are metalized, and they are poled in the thickness expansion mode.

Ceramic materials are often not piezoelectric until their random ferroelectric domains are aligned. This alignment is accomplished through a process known as "poling". Poling includes inducing a DC voltage across the material. The ferroelectric domains align to the induced field resulting in a net piezoelectric effect. It should be noted that not all the domains become exactly aligned. Some of the domains only partially align and some do not align at all. The number of domains that align depends upon the poling voltage, temperature, crystal structure, and the time the voltage is held on the material.

During poling, the material permanently increases in the dimension between the poling electrodes and decreases in dimensions parallel to the electrodes. The material can be de-poled by reversing the poling voltage, increasing the temperature beyond the material's Curie point, or by inducing a large mechanical stress in the opposite direction of the polarity.

Voltage applied to the electrodes at the same polarity as the original poling voltage results in an increase in the dimension between the electrodes and a decrease in the dimensions parallel to the electrodes. Applying a voltage to the electrodes in an opposite direction decreases the dimension between the electrodes and increases the dimension parallel to the electrodes.

In FIG. 2, first piezoelectric wafer 210 and second piezoelectric wafer 220 are bonded together such that polarity 212 and polarity 222 are aligned in the same direction.

In a preferred embodiment, terminals 232 and 252 are coupled to each other to form a first connection point, and terminal 242 is used as a second connection point. In this embodiment, a voltage is applied between the first connection point and the second connection point. In this way, a voltage is established across one wafer that is in the same direction as the poling voltage, and a voltage is established across the other wafer that is in the opposite direction as the poling voltage.

Desirably, one wafer increases in thickness and decreases in length while the other wafer decreases in thickness and increases in length. Therefore, a bending moment is established. By fixing one end of the actuator (as illustrated by mating surface 272), the bending moment is translated into vertical movement illustrated by double-headed arrows 290, 292, and 294.

In a preferred embodiment, the magnitude and polarity of the voltage applied between the first connection point and the second connection point are changed to control vertical movement as illustrated by double-headed arrow 294. In this way, the phase shift in waveguide phase shifter 200 is controlled.

Desirably, when a positive voltage is applied from the first connection point to the second connection point, the overall movement of the actuator is in a positive direction. This causes the dielectric vane to move higher, causing the amount of phase shift to decrease. In addition, when a negative voltage is applied from the first connection point to the second connection point, the overall movement of the actuator is in a negative direction. This causes the dielectric vane to move lower, causing the amount of phase shift to increase. Those skilled in the art will recognize that the effects caused by the negative and positive voltages can be different in alternate embodiments.

FIG. 3 illustrates a simplified view of a waveguide phase shifter in accordance with an alternate embodiment of the invention. In this embodiment, waveguide phase shifter 300 comprises waveguide 302, dielectric vane 355, spacer 365, attachment devices 304, control port 375, piezoelectric actuator 370, and attachment plane 380. In addition, FIG. 3 illustrates first reference surface 306, second reference surface 308, gap 374, centerline 318, and waveguide cavity 385.

In FIG. 3, actuator 370 is coupled to waveguide 302 using attachment devices 304. Those skilled in the art will recognize that other alternate embodiments can be envisioned in which attachment devices 304 are not required. Those skilled in the art will also recognize that other alternate embodiments can be envisioned in which attachment device 304 is used to couple actuator 370 to a different surface of waveguide 302.

In FIG. 3, the amount of phase shift provided by waveguide phase shifter 300 is controlled by, among other things, the position of dielectric vane 355 in waveguide cavity 385. Those skilled in the art will recognize that other alternate embodiments can be envisioned in which dielectric vane 355 is located in different positions.

In FIG. 3, dielectric vane 355 comprises a rectangular piece of dielectric material having stable dielectric properties at the operating frequency for waveguide phase shifter 300. Dielectric vane 355 is coupled to actuator 370 using spacer 365. Dielectric vane 355 is inserted into waveguide cavity 385 through control port 375. Gap 374 allows dielectric vane 355 to move freely within waveguide cavity 385. Control port 375 comprises a rectangular opening, which is machined into one of the walls of waveguide 302.

In FIG. 3, second reference surface 308 is located relative to first reference surface 306, and second reference surface 308 is located within the same plane as first reference surface 306 during at least one step of a fabrication process.

In FIG. 3, actuator 370 is illustrated as comprising a single stack. This is done to simplify the illustration of this embodiment. In this embodiment, actuator 370 comprises a plurality of stacks coupled to each other. Desirably, a stacked configuration is used for actuator 370 to allow lower voltages to be used to achieve the same overall total displacement.

In this embodiment, a stack comprises first piezoelectric wafer 310, second piezoelectric wafer 320, first metallic layer 330, second metallic layer 340, third metallic layer 350, and mating surface 372.

In FIG. 3, first metallic layer 330 is coupled to a first surface of first piezoelectric wafer 310. In this embodiment, the first surface of first piezoelectric wafer 310 has been metalized using well-known metalization techniques. Terminal 332 is coupled to first metallic layer 330.

In FIG. 3, third metallic layer 350 is coupled to a second surface of second piezoelectric wafer 320. In this embodiment, the second surface of second piezoelectric wafer 320 has been metalized using a well-known metalization technique. Terminal 352 is coupled to third metallic layer 350.

In FIG. 3, second metallic layer 340 is coupled to a second surface of first piezoelectric wafer 310 and is coupled to a first surface of second piezoelectric wafer 320. In this embodiment, the second surface of first piezoelectric wafer 310 and the first surface of second piezoelectric wafer 320 have been metalized using a well-known metalization technique. The two metalized surfaces have been mated together to form second metallic layer 340. Terminal 342 is coupled to second metallic layer 340. In other alternate embodiments, terminals 332, 342, and 352 can be configured in a number of different ways.

In FIG. 3, one end of spacer 365 is coupled to third metallic layer 350. In this embodiment, coupling is both mechanical and electrical. The other end of spacer 365 is coupled to dielectric vane 355 at surface 308. The coupling between dielectric vane 355 and spacer 365 is both mechanical and electrical.

In FIG. 3, first metallic layer 330 is coupled to attachment plane 380. In this embodiment, attachment plane 380 is coupled to waveguide 302 using at least one attachment device 304. In this way, one end 331 of actuator 370 is fixed, and this end 331 is not allowed to move relative to reference surface 306. Those skilled in the art will recognize that other embodiments can be envisioned in which a number of different attachment planes 380 can be used, and these other embodiments are within the scope of the invention.

In FIG. 3, spacing 391 is provided to allow movement as illustrated by double-headed arrow 392 to occur between a surface of actuator 370 and a surface of waveguide 302.

In FIG. 3, first piezoelectric wafer 310 has length 360, thickness 315, and polarity 312. In this embodiment, second piezoelectric wafer 320 has length 360, thickness 325, and polarity 322. Length 360, thickness 315 and thickness 325 are determined using known displacement equations to provide the required amount of movement. Movement is illustrated in FIG. 3 by double-headed arrows 390, 392, and 394. Desirably, movement as illustrated by double-headed arrow 390, movement as illustrated by double-headed arrow 392, and movement as illustrated by double-headed arrow 394 are equal.

In FIG. 3, polarity 312 is established using a first poling voltage, polarity 322 is established using a second poling voltage. In this embodiment, two separate piezoelectric wafers are metalized and mated together. Then, they are poled in the thickness expansion mode. In this embodiment, first piezoelectric wafer 310 and second piezoelectric wafer 320 are poled using the same poling voltage. Desirably, the poling operation causes polarity 312 and polarity 322 to be aligned in opposite directions.

In a preferred embodiment, terminals 332 and 352 are coupled to form a first connection point, and terminal 342 is used as a second connection point. In this embodiment, a voltage is applied between the first connection point and the second connection point. In this way, a voltage is established across each wafer that is in the same direction as the poling voltage.

Desirably, both wafers increase in thickness and decrease in length when the applied voltage is in the same direction as the poling voltage. Consequently, the distance between the metallic layers increases.

Desirably, both wafers decrease in thickness and increase in length when the applied voltage is in the opposite direction from the poling voltage. Therefore, the distance between the metallic layers decreases.

By fixing end 331 (mating surface 372) of actuator 370, the changes in thickness are translated into vertical movement illustrated by double-headed arrows 390, 392, and 394. The magnitude and polarity of the voltage applied between the first connection point and the second connection point are changed to control vertical movement as illustrated by double-headed arrow 394. In this way, the phase shift in waveguide phase shifter 300 is controlled.

Piezoelectric wafers are illustrated in FIG. 2 and FIG. 3 as being substantially the same size. That is, they are illustrated having substantially the same width, substantially the same length, and substantially the same thickness. Those skilled in the art will recognize that piezoelectric wafers having different dimensions can be used in other alternate embodiments.

Metallic layers are illustrated in FIG. 2 and FIG. 3 as being substantially the same size. That is, they are illustrated having substantially the same width, substantially the same length, and substantially the same thickness. Those skilled in the art will recognize that metallic layers having different dimensions can be used in other alternate embodiments.

Desirably, the piezoelectric material used for the piezoelectric wafers is selected from a group consisting of lead-titanate ($PbTiO_3$), lead-zirconate ($PbZrO_3$), barium-titanate ($BaTiO_3$), and lead-zirconate-titanate ($PbZr_xTi_{1-x}O_3$), where x is between zero and one. The subscripts (x and 1−x) are used to represent the amounts of lead-zirconate and lead-titanate, respectively.

In alternate embodiments, the piezoelectric material could be an electrically active polymer material. In these embodiments, the dimensional change versus voltage of an electrically active polymer material can be 100 to 1000 times greater than the change for a conventional piezoelectric material.

Actuators 270 and 370 can be fabricated using a multilayer ceramic technology known as tape casting. In alternate embodiments, other manufacturing techniques using ceramic materials can be used to fabricate actuators. When multilayer ceramic technology is used, metallic layers can be placed between the layers of ceramic material, and the entire package can be co-fired in a single operation. For example, actuator 370 as illustrated in FIG. 3 can be formed using two unfired ceramic layers interspersed with layers comprising at least one conductive metal. In some embodiments, a bonding agent can be used as a holding mechanism for the ceramic material.

Figure 4:
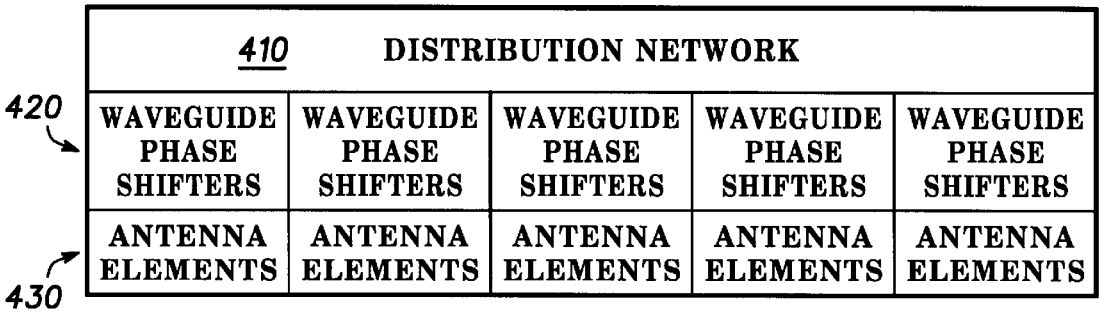
FIG. 4 illustrates a simplified block diagram for a phased array antenna using a waveguide phase shifter in accordance with a preferred embodiment of the invention.

FIG. 4 illustrates a simplified block diagram for a phased array antenna using a waveguide phase shifter in accordance with a preferred embodiment of the invention. Phased array antenna 400 comprises distribution network 410, a number of waveguide phase shifters 420 coupled to distribution network 410, and a number of antenna elements 430 coupled to waveguide phase shifters 420.

In a preferred embodiment, distribution network 410 comprises waveguide transitions that are coupled to waveguide phase shifters 420. In a preferred embodiment, antenna elements 430 are waveguide devices. For example, waveguide horns can be used.

In a preferred embodiment, waveguide phase shifters 420 comprise waveguide phase shifters as illustrated by waveguide phase shifter 200.

Figure 5:
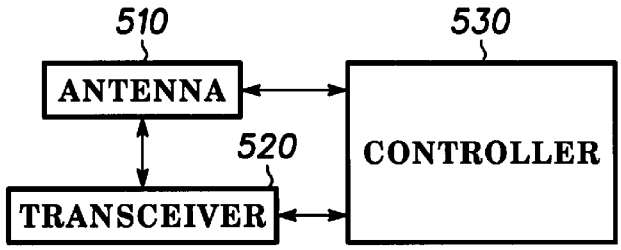
FIG. 5 shows a simplified block diagram of subscriber equipment, also known as customer premises equipment (CPE), in accordance with a preferred embodiment of the invention.

FIG. 5 shows a simplified block diagram of subscriber equipment, also known as customer premises equipment (CPE) in accordance with a preferred embodiment of the invention. CPE 500 comprises phased array antenna 510, transceiver 520, and controller 530. Phased array antenna 510 is coupled to transceiver 520. Controller 530 is coupled to phased array antenna 510 and transceiver 520.

In a preferred embodiment, phased array antenna 510 comprises at least one phased array antenna as illustrated by phased array antenna 400 in FIG. 4. In this embodiment, controller 530 is used to provide the control voltages to waveguide phase shifters as illustrated by waveguide phase shifters 420 in FIG. 4.

Typically, CPE 500 is mounted on a rooftop or similar location at a subscriber's residence or place of business. In many applications, cost and viewing angle are significant factors for a commercially successful CPE 500. This means that there is a significant need for a low cost phased array antenna as provided by phased array antenna 400 (FIG. 4). Desirably, phased array antenna 510 comprises at least one antenna that can be steered over a wide field of view as provided by phased array antenna 400 (FIG. 4).

Figure 6:
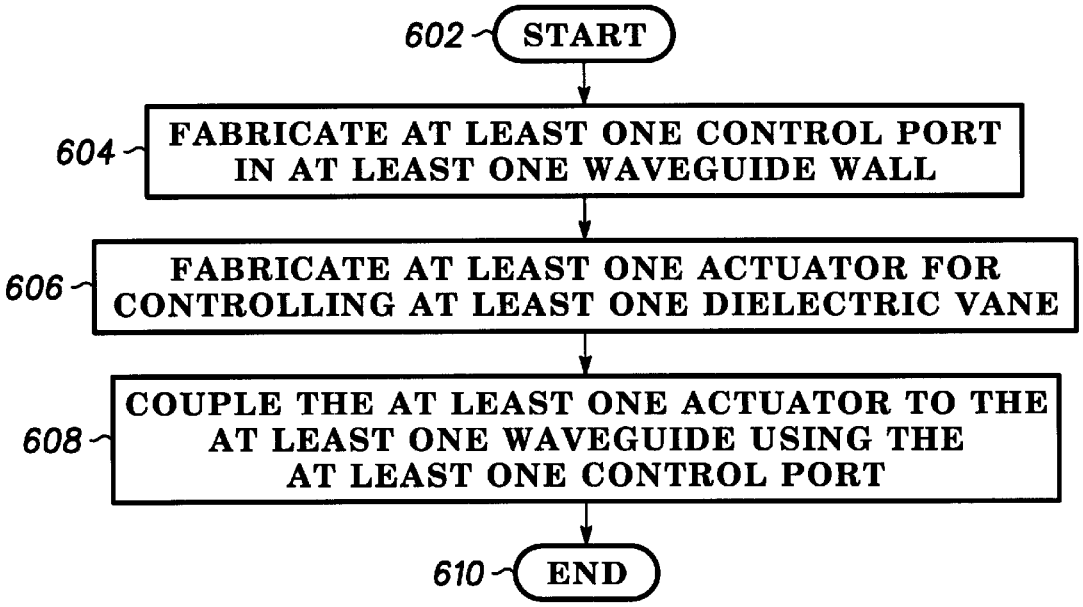
FIG. 6 illustrates a flowchart of a method for manufacturing a waveguide phase shifter that is performed in accordance with a preferred embodiment of the present invention.

FIG. 6 illustrates a flowchart of a method for manufacturing a waveguide phase shifter that is performed in accordance with a preferred embodiment of the present invention. Procedure 600 starts in step 602.

In step 604, at least one control port is fabricated in at least one waveguide. Desirably, the control port comprises a void in a wall of the waveguide. For example, a rectangular hole can be machined in the top wall of a rectangular waveguide. The control port allows a dielectric vane to be inserted into the waveguide, and the position of the dielectric vane within a waveguide cavity is controlled to change the phase shift in a waveguide phase shifter.

In step 606, at least one piezoelectric actuator is fabricated for controlling the position of the dielectric vane. A procedure for manufacturing at least one piezoelectric actuator is shown below in FIG. 7.

In step 608, at least one piezoelectric actuator is coupled to at least one waveguide using at least one control port, thereby forming a waveguide phase shifter.

Procedure 600 ends in step 610.

Figure 7:
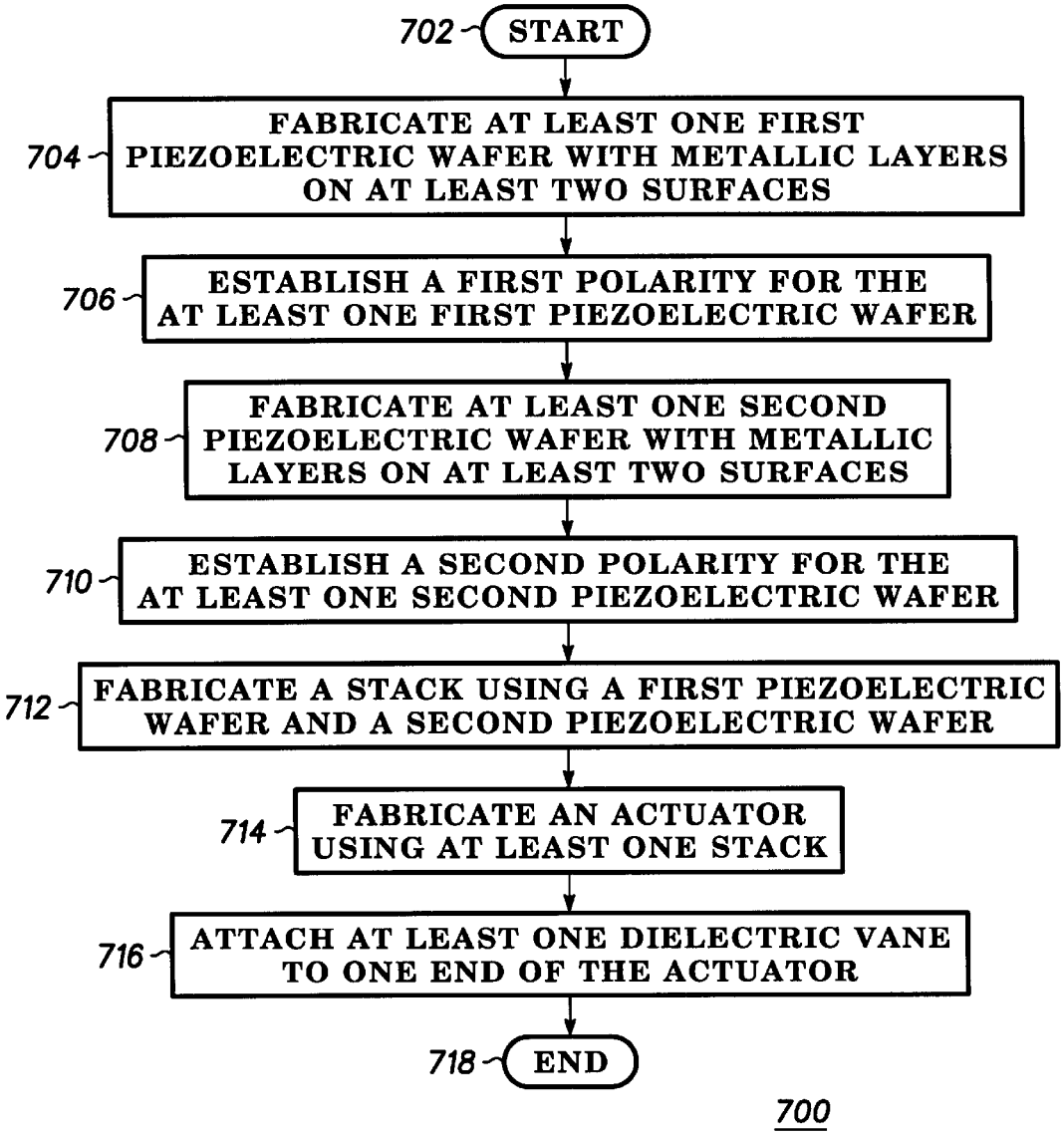
FIG. 7 illustrates a flowchart of a method for manufacturing a piezoelectric actuator for use in a waveguide phase shifter that is performed in accordance with a preferred embodiment of the present invention.

FIG. 7 illustrates a flowchart of a method for manufacturing a piezoelectric actuator for use in a waveguide phase shifter that is performed in accordance with a preferred embodiment of the present invention. Procedure 700 starts in step 702.

In step 704, at least one first piezoelectric wafer is fabricated having metallic layers on at least two opposing surfaces.

In step 706, a first polarity is established for the at least one first piezoelectric wafer using a first poling voltage. The first poling voltage is applied across the first piezoelectric wafer using the metallic layers.

In step 708, at least one second piezoelectric wafer is fabricated having metallic layers on at least two opposing surfaces.

In step 710, a second polarity is established for the at least one second piezoelectric wafer using a second poling voltage. The second poling voltage is applied across the second piezoelectric wafer using the metallic layers.

In step 712, a stack is fabricated by mating a first piezoelectric wafer to a second piezoelectric wafer so that the first polarity and the second polarity are aligned in the same direction, as illustrated in FIG. 2. In alternate embodiments, a stack can be fabricated by mating the first piezoelectric wafer to the second piezoelectric wafer so that the first polarity and the second polarity are aligned in opposite directions, as illustrated in FIG. 3.

In step 714, at least one actuator is fabricated using at least one stack. Desirably, each actuator comprises two stacks. In alternate embodiments, an actuator can comprise a plurality of stacks coupled to each other. In these embodiments, a stacked configuration is used for the actuator to allow lower voltages to be used to achieve the same overall total displacement.

In a preferred embodiment, connection points are established for each piezoelectric actuator. Desirably, when a positive voltage is applied from a first connection point to a second connection point, the actuator's displacement is in a positive direction. In addition, when a negative voltage is applied from a first connection point to a second connection point, the actuator's displacement is in a negative direction.

In step 716, at least one dielectric vane is coupled to one end of each actuator. In a preferred embodiment, a conductive spacer, as illustrated by spacer 265 in FIG.2, is used to couple a dielectric vane to an actuator. Desirably, the conductive spacer is used to properly position the actuator within the waveguide cavity relative to at least one reference surface. Alternate embodiments can be envisioned that do not require a conductive spacer.

Procedure 700 ends in step 718.

The invention provides a simple, low-cost, and repeatable method for producing a waveguide phase shifter for use in a phased array antenna. The indirect piezoelectric effect is used to provide movement. The movement is used to control the position of a dielectric vane within a waveguide, thereby creating a waveguide phase shifter. One or more waveguide phase shifters are used in a phased array antenna to allow the phased array antenna to be steered over a wide field of view.

The invention has been described above with reference to a preferred embodiment. However, those skilled in the art will recognize that changes and modifications can be made in this preferred embodiment without departing from the scope of the invention. For example, the number of piezoelectric layers identified herein can be changed while achieving substantially equivalent results.

What is claimed is:

1. A waveguide phase shifter comprising:

a waveguide having a control port, said control port comprising a void in a wall of said waveguide;

a dielectric vane at a first position relative to a first reference surface, said first position being within said waveguide; and an actuator coupled to said waveguide and coupled to said dielectric vane through said control port, said actuator changing said first position using a plurality of stacks of potable ferroelectric ceramic material, at least one stack of said plurality of stacks comprising at least two piezoelectric wafers comprised of a respective potable ferroelectric ceramic material selected from a group consisting of lead-titanate ($PbTiO_3$), lead-zirconate ($PbZrO_3$), barium-titanate ($BaTiO_3$), and lead-zirconate-titanate ($PbZr_xTi_{1-x}O_3$), where x is between zero and one.

2. The waveguide phase shifter as recited in claim 1, wherein said at least one stack further comprises:

a first piezoelectric wafer having a first length, a first thickness, a first width, a first polarity, a first surface, a second surface, a first end, said first thickness thereof being a distance between said first surface thereof and said second surface thereof, said first length thereof being a distance from said first end thereof;

a second piezoelectric wafer having a second length, a second thickness, a second width, a second polarity, a first surface, a second surface, a first end, said second thickness thereof being a distance between said first surface thereof and said second surface thereof, said second length thereof being a distance from said first end thereof;

a first metallic layer coupled to said first surface of said first piezoelectric wafer;

a second metallic layer coupled to said second surface of said first piezoelectric wafer and coupled to said first surface of said second piezoelectric wafer;

third metallic layer coupled to said second surface of said second piezoelectric wafer; and a mating surface coupling said actuator to said waveguide, said mating surface being located at said first end of said firm piezoelectric wafer.

3. The waveguide phase shifter as recited in claim 2, wherein said actuator further comprises:

a first terminal coupled to said first metallic layer;

a second terminal coupled to said second metallic layer; and a third terminal coupled to said third metallic layer.

4. The waveguide phase shifter as recited in claim 2, wherein said first polarity and said second polarity are aligned in opposite directions.

5. The waveguide phase shifter as recited in claim 2, wherein said actuator further comprises a spacer coupling said actuator to said dielectric vane.

6. The waveguide phase shifter as recited in claim 2, wherein said first polarity is established using a first poling voltage and said second polarity is established using a second poling voltage.

7. The waveguide phase shifter as recited in claim 6, wherein said first piezoelectric wafer is poled in a thickness expansion mode using said first poling voltage and said second piezoelectric wafer is poled in a thickness expansion mode using said second poling voltage.

8. The waveguide phase shifer as recited in claim 2, wherein said first polarity and said second polarity are aligned in a same direction.

9. A method for manufacturing a waveguide phase shifter, said method comprising the steps of:

a) fabricating at least one control port In a wall of a waveguide, said at least one control port comprising at least one void in said wall and providing access to a cavity within said waveguide;

b) fabricating at least one piezoelectric actuator comprising a plurality of stacks fabricated using polable ferroelectric ceramic material, at least one stack of said plurality of stacks comprising at least two piezoelectric wafers, wherein each piezoelectric wafer is comprised of a respective polable ferroelectric ceramic material selected from a group consisting of lead-titanate ($PbTiO_3$), lead-zirconate ($PbZrO_3$), barium-titanate ($BaTiO_3$), and lead-zirconate-titanate ($PbZr_xTi_{1-x}O_3$), where x is between zero and one;

c) coupling said at least one piezoelectric actuator to said waveguide; and d) coupling at least one dielectric vane to said at least one piezoelectric actuator, said at least one dielectric vane being located at a first position within said cavity, wherein said at least one piezoelectric actuator comprises means for changing said first position through said at least one control port.

10. The method as recited in claim 9, wherein step d) further comprises the steps of:

d1) establishing a first connection point on said at least one piezoelectric actuator; and d2) establishing a second connection point on said at least one piezoelectric actuator, whereby when a positive voltage is applied from said first connection point to said second connection point, said at least one dielectric vane moves higher relative to said first position and when a negative voltage is applied from said first connection point to said second connection point, said at least one dielectric vane moves lower relative to said first position.

11. The method as recited in claim 9, wherein step b) further comprises the step of:

b1) fabricating a first piezoelectric wafer having a first length, a first thickness, a first width, a first polarity, a first metallic layer, a second metallic layer, a first end, said first thickness thereof being a distance between said first metallic layer thereof and said second metallic layer thereof, said first length thereof being a distance from said first end thereof.

12. The method as recited in claim 11, wherein step b1) further comprises the step of:

b1a) establishing said first polarity by poling said first piezoelectric wafer in a thickness expansion mode using a first poling voltage.

13. The method as recited in claim 11, wherein step b) further comprises the step of:

b2) fabricating a second piezoelectric wafer having a second length, a second thickness, a second width, a second polarity, a first metallic layer, a second metallic layer, a first end, said second thickness thereof being a distance between said first metallic layer thereof and said second metallic layer thereof, said second length thereof being a distance from said first end thereof.

14. The method as recited in claim 13, wherein step b) further comprises the step of:

b3) fabricating said at least one stack by mating said first piezoelectric wafer to said second piezoelectric wafer so that said first polarity and said second polarity are aligned in a common direction.

15. The method as recited in claim 14, wherein step b) further comprises the steps of:

b4) coupling at least one dielectric vane to a second end of said at least one piezoelectric actuator.

16. The method as recited in claim 15, wherein step c) further comprises the step of:

c1) attaching a mating surface of said at least one piezoelectric actuator to an attachment plane, said attachment plane being fixed relative to said wall of said waveguide.

17. The method as recited in claim 13, wherein step b) further comprises the step of:

b3) fabricating at least one stack of said plurality of stacks by mating said first piezoelectric wafer to said second piezoelectric wafer so that said first polarity and said second polarity are aligned in opposite directions.

18. The method as recited in claim 13, wherein step b2) further comprises the step of:

b2a) establishing said second polarity by poling said second piezoelectric wafer in a thickness expansion mode using a second poling voltage.

* * * * *

UNITED STATES PATENT AND TRADEMARK OFFICE

CERTIFICATE OF CORRECTION

PATENT NO. : 6,281,766 B1
DATED : August 28, 2001
INVENTOR(S) : Hugh R. Malone

It is certified that error appears in the above-identified patent and that said Letters Patent is hereby corrected as shown below:

Title page,
Item [54], Title, Delete "STACKED PIEZOELECTRIC ACTUATORS TO CONTROL WAVEGUIDE PHASE SHIFTERS AND METHOD OF MANUFACTURE THEREOF" and insert -- PHASED ARRAY ANTENNA USING PIEZOELECTRIC ACTUATORS TO CONTROL WAVEGUIDE PHASE SHIFTERS AND METHOD OF MANUFACTURE THEREOF --.

Signed and Sealed this

Thirtieth Day of September, 2003

JAMES E. ROGAN
*Director of the United States Patent and Trademark Office*